US009028301B2

(12) United States Patent
Schnyder

(10) Patent No.: US 9,028,301 B2
(45) Date of Patent: May 12, 2015

(54) HOLDING BODY FOR FLEXIBLE GRINDING DEVICE AND GRINDING SYSTEM

(75) Inventor: Juerg Schnyder, Nuerensdorf (CH)

(73) Assignee: Robert Bosch GmbH, Stuttgart (DE)

( * ) Notice: Subject to any disclaimer, the term of this patent is extended or adjusted under 35 U.S.C. 154(b) by 103 days.

(21) Appl. No.: 13/638,854

(22) PCT Filed: Feb. 24, 2011

(86) PCT No.: PCT/EP2011/052743

§ 371 (c)(1),
(2), (4) Date: Dec. 17, 2012

(87) PCT Pub. No.: WO2011/120740

PCT Pub. Date: Oct. 6, 2011

(65) Prior Publication Data

US 2013/0210325 A1 Aug. 15, 2013

(30) Foreign Application Priority Data

Apr. 1, 2010 (DE) ..... 10 2010 003 616

(51) Int. Cl.
*B24B 55/10* (2006.01)
*B24B 23/00* (2006.01)
*B24D 9/08* (2006.01)

(52) U.S. Cl.
CPC ..... *B24D 9/08* (2013.01); *B24B 55/102* (2013.01); *B24D 9/085* (2013.01)

(58) Field of Classification Search
CPC ..... B24D 9/08; B24B 23/00; B24B 55/10; B24B 55/102; B24B 55/105
USPC ..... 451/488, 354, 359, 456
See application file for complete search history.

(56) References Cited

U.S. PATENT DOCUMENTS

| | | | | |
|---|---|---|---|---|
| 4,062,152 | A * | 12/1977 | Mehrer | 451/344 |
| 4,937,984 | A * | 7/1990 | Taranto | 451/524 |
| 5,036,627 | A * | 8/1991 | Walters | 451/354 |
| 6,988,940 | B1 * | 1/2006 | Taylor | 451/354 |
| 8,052,506 | B2 * | 11/2011 | Rivard et al. | 451/490 |
| 2005/0233681 | A1 * | 10/2005 | Jost | 451/49 |
| 2007/0066198 | A1 * | 3/2007 | Rambosek et al. | 451/533 |

FOREIGN PATENT DOCUMENTS

| | | | |
|---|---|---|---|
| CN | 1233549 | A | 11/1999 |
| CN | 1278202 | A | 12/2000 |
| CN | 101262983 | A | 9/2008 |

(Continued)

OTHER PUBLICATIONS

International Search Report corresponding to PCT Application No. PCT/EP2011/052743, mailed Jul. 19, 2011 (German and English language document) (5 pages).

*Primary Examiner* — Robert Rose
(74) *Attorney, Agent, or Firm* — Maginot, Moore & Beck LLP

(57) ABSTRACT

A holding body includes a fastening layer which has a fastening surface configured to fasten a flexible grinding device. The fastening layer includes an air- and dust-permeable material and is substantially full-surface. The fastening layer includes a textile material. The holding body also includes a supporting body which has a supporting surface configured to support a holding surface of the fastening layer. The supporting body is air- and dust-permeable and includes an open-cell foam. A grinding system includes such a holding body and such a flexible grinding device.

19 Claims, 1 Drawing Sheet

(56) References Cited

FOREIGN PATENT DOCUMENTS

| | | | |
|---|---|---|---|
| CN | 201279728 | Y | 7/2009 |
| CN | 101633143 | A | 1/2010 |
| DE | 20 2004 006 078 | U1 | 7/2004 |
| DE | 20 2009 000 880 | U1 | 8/2009 |
| EP | 0 781 629 | A1 | 7/1997 |
| EP | 1 977 858 | A1 | 10/2008 |
| WO | 99/67057 | A1 | 12/1999 |
| WO | 2009/088772 | A2 | 7/2009 |

* cited by examiner

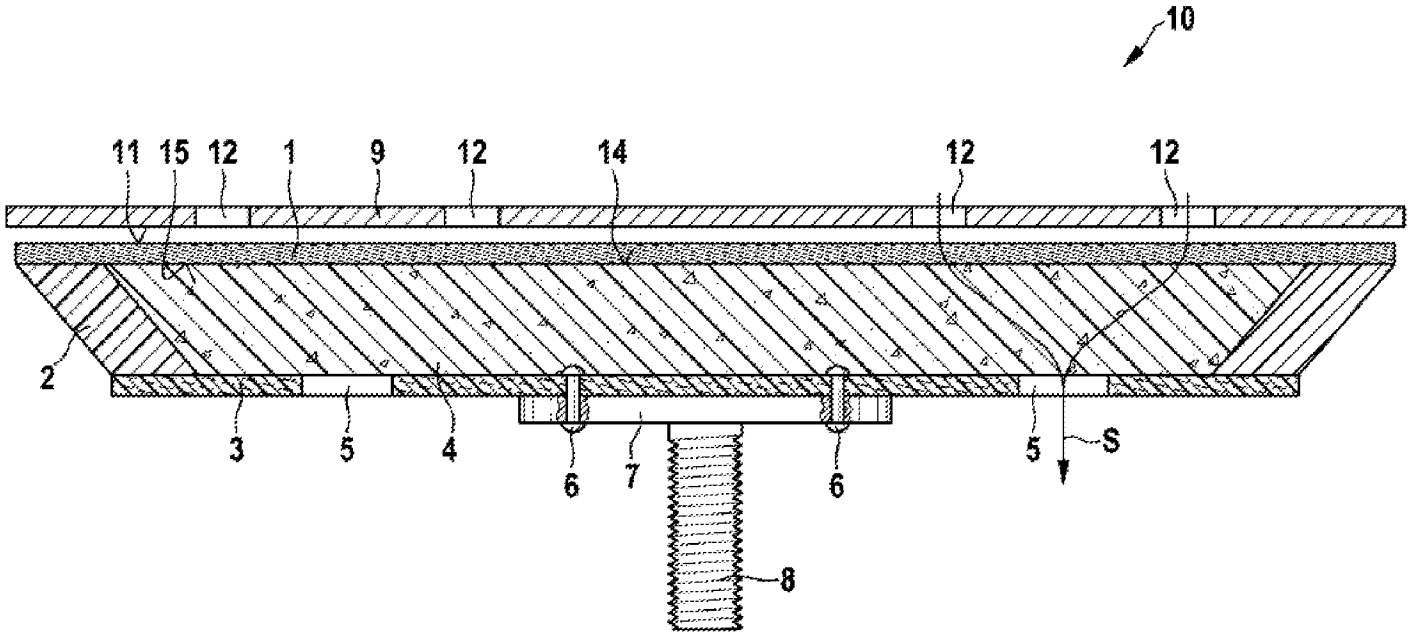
10
11
15
12
1
9
12
14
12
12
2
3
5
4
6
7
6
8
5
S

HOLDING BODY FOR FLEXIBLE GRINDING DEVICE AND GRINDING SYSTEM

This application is a 35 U.S.C. §371 National Stage Application of PCT/EP2011/052743, filed on Feb. 24, 2011, which claims the benefit of priority to Serial No. DE 10 2010 003 616.1, filed on Apr. 1, 2010 in Germany, the disclosures of which are incorporated herein by reference in their entirety.

BACKGROUND

The present disclosure relates to a holding body for a flexible grinding device, in particular a grinding pad, and to a grinding system with such a holding body and a flexible grinding device.

Holding bodies of the type in question in the form of grinding pads are described, for example, in DE 20 2009 000 880 and EP 0 781 629 A1. These grinding pads have a soft supporting body, which may for example comprise foam material, and have a Velcro or adhesive layer for connecting to a flexible grinding means. The flexible grinding means may be, for example, a grinding disk. These known grinding pads have a number of axially extending bores, through which air and grinding dust occurring during the grinding can be sucked away. These bores pass through both the soft layer and the Velcro or adhesive layer.

The necessary bores have the effect of producing for the respective grinding pad a characteristic pattern of holes, to which the grinding means that can be used with said pad must be adapted. To be specific, said grinding means must themselves have holes in a corresponding pattern. This is particularly disadvantageous, since only quite specific grinding means can be used with a given grinding pad. Furthermore, when the grinding means is fastened to the grinding pad, the relative alignment of the grinding means in relation to the grinding pad must be observed, in order that the holes in the grinding means are congruent with the holes in the grinding pad, and consequently suction removal is possible. Structurally complex solutions to this problem are known, for example, from EP 1 977 858 or WO 2009/088772 A2.

SUMMARY

It is therefore an object of the present disclosure to provide a holding body for a flexible grinding device or a flexible grinding means, in particular a grinding pad, having a fastening surface for fastening a flexible grinding means, with which it is also possible for different flexible grinding means to be used irrespective of their pattern of holes and with which the suction removal effect is virtually independent of the relative alignment of a grinding means with respect to the holding body.

This object is achieved by a holding body for a flexible grinding device or a flexible grinding means according to the disclosure.

In some embodiments, the holding body is formed as a grinding pad. In other embodiments, the holding body may also be formed as a rubbing down block or as a grinding plate or as an adapter. An adapter may be used for example for adapting a flexible grinding means to a grinding pad.

The holding body comprises a fastening layer with a fastening surface for fastening a flexible grinding means.

The holding body also has a supporting body with a supporting surface. This supporting surface supports a holding surface of the fastening layer. Such a supporting body may press the fastening layer, and with it the flexible grinding means fastened thereto, against a surface to be worked. The supporting body is permeable to air and dust, in particular consists of air- and dust-permeable material. Alternatively, however, the supporting body may also have a large number of openings of small diameter.

The holding surface may be opposite from the fastening surface of the fastening layer. In particular, the supporting surface may be connected to the holding surface.

According to the disclosure, the fastening layer consists of an air- and dust-permeable material. Suction removal of air and dust is consequently possible both through the fastening layer and through the supporting body.

In the sense intended by the present disclosure, a material is referred to as dust-permeable if it can be flowed through by grinding dust that usually occurs during the working of workpieces. The particles of the grinding dust typically have sizes that are approximately 10% of the sizes of the abrasive grains. For example, the sizes of the particles of the grinding dust can lie in the range from 1 to 200 μm. Furthermore, a material is referred to as air-permeable if it can be flowed through by air under negative pressures for suction removal that are customary during grinding. In particular, the material may be permeable to air such that suction removal of air is possible by a suction removal system that generates a volumetric flow of approximately 200 to 500 $m^3/h$.

As a result of the way in which the fastening layer is formed, substantially uniform suction removal of air and grinding dust is possible over the entire fastening surface—and not only in the region of individual holes. For this reason, the holding body can be used with any flexible grinding means having holes: the holes of the flexible grinding means are always located in a region of the fastening surface through which suction removal of air and dust is possible. In addition, by contrast with known holding bodies, the suction removal effect is virtually independent of the relative rotational position between the grinding pad and the flexible grinding means. Moreover, production of the fastening layer is also particularly easy, since the original material (that is to say for example a textile material) does not have to be perforated in a further step.

The fastening surface is preferably substantially full-surfaced. The fastening layer is referred to as substantially full-surfaced if it contains no further holes apart from the openings or pores that are intrinsic in the material. For example, the fastening layer may comprise or consist of a textile material. As a result of the way in which it is produced, such a textile material has openings between the threads, through which air can flow. A textile layer that is full-surfaced in the sense intended by the disclosure does not however contain any further holes apart from these openings. Alternatively, however, it is also conceivable that the fastening surface has further perforations in addition to the openings that are intrinsic in the material.

The fastening surface preferably has mechanical fastening means for fastening a flexible grinding means. In particular, these fastening means may be loops and/or hooks that protrude from the fastening surface. Such fastening means are both inexpensive and effective. Alternatively, the fastening means may also be formed as studs or in an anchor T-head form.

In further conceivable embodiments, the fastening surface may be of a self-adhesive form and, for example, have an adhesive. This allows the fastening surface to be fastened to a flexible grinding means by adhesive bonding. The fastening layer may be formed, for example, as a textile material, such as for example as a woven or knitted fabric, which is coated with an adhesive. The textile material may, for example, be a velour. Alternatively, the fastening layer may be formed as a mesh. In further possible embodiments, the fastening layer may also be formed as an open-cell foam material, which is coated with an adhesive.

In other conceivable embodiments, the fastening surface may not have a fastening means at all. For example, it may have a substantially planar surface, on which a flexible grinding means coated with an adhesive can be fastened.

The fastening layer preferably comprises or consists of a textile material. In particular, it may be a textile material having loops and/or hooks and/or stud heads. Such fastening means are likewise both inexpensive and effective and can be obtained, for example, from the company Velcro USA Inc., Manchester, N.H. 03103, USA. A textile material having hooks may be produced, for example, from a textile material having loops, in that the loops are cut open and the textile material is subsequently impregnated. Such materials are likewise known per se.

Particularly advantageously, the supporting surface supports the holding surface substantially over the full surface and, in particular, is consequently connected to it substantially over the full surface. This allows the fastening layer, consequently also the flexible grinding means fastened thereto, to be pressed over the full surface against a material to be worked.

Particularly advantageously, the supporting body comprises or consists of an open-cell foam material. The foam material may, for example, comprise or consist of polyester-polyurethane, polyether-polyurethane, a prepolymer, melamine or a combination thereof. Alternatively, however, the supporting body may also, for example, comprise or consist of a knitted spacer fabric or a honeycomb structure. The supporting pad may preferably be enclosed at its periphery by an air-impermeable stabilizing body.

The fastening layer is preferably in flow connection with a suction removal opening of the holding body, which is at a distance from the fastening layer. This allows grinding dust that is produced during grinding to be actively removed by suction, in that a negative pressure is applied to the suction removal opening. With particular advantage, the suction removal opening is arranged on the side of the holding body that is opposite from the fastening layer. This makes particularly easy suction removal possible.

The holding body may contain at least one air chamber for the suction removal of air and dust, the air chamber being in flow connection with the fastening layer and the suction removal opening.

The holding body may also have fastening means for fastening the holding body to a drive. For example, the holding body may be formed as a grinding pad, the fastening means being designed for fastening to a rotatable drive of a grinding machine, an eccentric drive of a grinding machine, a linear drive of a grinding machine or a combination thereof. Such fastening means on grinding pads are known per se.

The disclosure also relates to a grinding system, which comprises at least one holding body as described above for a flexible grinding means, in particular a grinding pad, and at least one flexible grinding means. The flexible grinding means can be fastened to the fastening surface of the holding body. The flexible grinding means may be, for instance, a grinding disk.

The flexible grinding means may have holes, through which dust can be removed by suction. Suction removal of dust is of course also possible if, in the same way as the fastening layer, the grinding means consists of an air- and dust-permeable material and does not contain any further holes apart from openings or pores that are intrinsic in the material.

The grinding system may also have a number of flexible grinding means that are different from one another. In particular, the patterns of holes of the grinding means may be different from one another.

Such a grinding system makes it possible for a number of different flexible grinding means to be used with one and the same holding body. As a result of the properties according to the disclosure of the holding body, and in particular the fastening layer thereof, suction removal of air and grinding dust is possible, and is so independently of the pattern of holes of the grinding means and also the relative position of the grinding means in relation to the holding body, in particular the relative rotational position of the grinding means with respect to a grinding pad.

BRIEF DESCRIPTION OF THE DRAWINGS

The disclosure is explained below on the basis of an exemplary embodiment and a drawing.

DETAILED DESCRIPTION

The drawing shows a lateral sectional view of a holding body according to the disclosure, which is formed as a grinding pad 10. The grinding pad 10 has a top sheet 3 of glass fiber. The top sheet 3 contains a number of suction removal openings 5, which pass through in the axial direction and only two of which can be seen here. The top sheet 3 is connected with the aid of rivets 6 to a metal plate 7. Fastened to this metal plate 7 is a screw 8, with which the grinding pad 10 can be fastened to a rotating drive of a grinding machine that is not represented here. The screw 8 consequently serves as a fastening means.

In other embodiments that are not represented here, the metal plate 7, the rivets 6 and the screw 8 are not part of the grinding pad 10, but part of a receptacle on the machine for the grinding pad 10. In this case, the top sheet 3 forms the fastening means of the grinding pad 10, with which the grinding pad 10 can be fastened to the drive.

On the side of the top sheet 3 that is facing away from the metal plate 7, the grinding pad 10 has a supporting body 4. The supporting body consists of an air- and dust-permeable, open-cell foam material. The foam material may, for example, comprise or consist of polyester-polyurethane, polyether-polyurethane, a prepolymer, melamine or a combination thereof. In particular, filter foams are suitable. The foam material should, in particular, be waterproof, aging-resistant and undergo little fatigue. Furthermore, it should be able to withstand typical working temperatures of approximately 0° C. to 180° C. In the radial direction, the supporting pad 4 is enclosed by an air- and dust-impermeable stabilizing body 2, which consists of foam material. With the aid of the stabilizing body 2, a lateral inflow of air can be prevented.

On the side of the supporting body 4 that is facing away from the top sheet 3, the supporting body 4 has a supporting surface 14. Connected to this supporting surface 14 is a holding surface 15 of a fastening layer 1. As a result, the supporting surface 14 supports the holding surface 15 substantially over the full surface. The connection between the supporting surface 14 and the holding surface 15 may be achieved, for example, by adhesive bonding, flame bonding or ultra-high frequency welding. In order to adhesively bond the supporting surface 14 and the holding surface 15 to each other, they are preferably only provided with an adhesive superficially, for instance by kiss coating. In this way it is ensured that the pores in the supporting body 4 and in the fastening layer 1 are not clogged and that the desired air and dust permeability is also retained after the adhesive bonding. The method for the adhesive bonding is known per se to a person skilled in the art; the required amount of adhesive to be applied can be determined by routine tests.

The fastening layer 1 is a textile material. As a result of the openings between the individual threads of the textile material, the fastening layer 1 is permeable to air and dust. The textile material should, in particular, be waterproof, aging-resistant and undergo little fatigue. Furthermore, it should be able to withstand typical working temperatures of approximately 0° C. to 180° C. Such textile materials are known per se to a person skilled in the art. Furthermore, the fastening layer 1 is circular and full-surfaced. The fastening layer 1 therefore has no further holes apart from the openings between the threads of the textile material. As a result, full-surface suction removal of air and grinding dust is ensured.

The textile material of the fastening layer 1 has on the fastening surface 11, opposite from the holding surface 15, a multiplicity of hooks, which however cannot be seen in the drawing. The hooks form mechanical fastening means for fastening a flexible grinding means. For this purpose, the flexible grinding means has loops, which can engage in the hooks of the fastening surface 11. In the drawing, the flexible grinding means is formed as a grinding disk 9. In the drawing, the grinding disk 9 is shown separate from the grinding pad 10 in the sense of an exploded representation.

During the operation of the grinding pad 10 with the grinding disk 9 fastened thereto, air and dust can be removed by suction through the holes 12 in the grinding disk 9, through the fastening layer 1, through the supporting body 4 and through the outlet openings 5. The stream of air and dust is denoted by S. The suction removal effect is consequently virtually independent of the pattern of holes of the grinding disk 9 and also the relative rotational position between the grinding disk 9 and the grinding pad 10.

The invention claimed is:

1. A holding body for a flexible grinding device comprising:

a fastening layer having a fastening surface and a holding surface located opposite from the fastening surface, the fastening surface having a fastening member configured to fasten the flexible grinding device; and a supporting body having a supporting surface connected to the holding surface of the fastening layer so as to support the fastening layer, wherein the fastening layer and the supporting body are each formed from an air- and dust-permeable material configured to enable substantially uniform suction removal of air and grinding dust through substantially the entire fastening surface and through substantially the entire fastening layer and through the supporting body, and wherein the supporting surface is connected to the holding surface in an unreleasable manner.

2. The holding body as claimed in claim 1, wherein the fastening surface is substantially full-surfaced.

3. The holding body as claimed in claim 1, wherein the fastening member includes at least one of loops and hooks protruding from the fastening surface.

4. The holding body as claimed in claim 1, wherein the fastening layer includes a textile material.

5. The holding body as claimed in claim 1, wherein the supporting surface is connected so as to support the holding surface substantially over all of the supporting surface.

6. The holding body as claimed in claim 1, wherein the supporting body includes an open-cell foam material, a knitted spacer fabric, or a honeycomb structure.

7. The holding body as claimed in claim 1, further comprising a fastening mechanism configured to fasten the holding body to a drive, the drive being at least one of a rotatable drive, an eccentric drive, and a linear drive.

8. The holding body as claimed in claim 7, further comprising a suction removal opening spaced from the fastening layer and arranged opposite the fastening layer, the fastening layer in flow connection with the suction removal opening, the suction removal opening being configured to move synchronously with a movement of the drive.

9. The holding body as claimed in claim 1, wherein the supporting body is enclosed at a periphery by an air-impermeable stabilizing body.

10. A grinding system comprising:

at least one holding body; and at least one flexible grinding device configured to be fastened to the at least one holding body, the holding body including:

a fastening layer having a fastening surface and a holding surface located opposite from the fastening surface, the fastening surface having a fastening member configured to fasten the flexible grinding device; and a supporting body having a supporting surface connected to the holding surface of the fastening layer so as to support the fastening layer, wherein the fastening layer and the supporting body are each formed from an air-and dust-permeable material configured to enable substantially uniform suction removal of air and grinding dust through substantially the entire fastening surface and through substantially the entire fastening layer and through the supporting body, and wherein the supporting surface is connected to the holding surface in an unreleasable manner.

11. The holding body as claimed in claim 1, wherein the supporting surface is connected to the holding surface by one or more of adhesive bonding, flame bonding, and ultra-high frequency welding.

12. The holding body as claimed in claim 4, wherein the textile material of the fastening layer has at least one of loops, hooks, and stud heads.

13. The holding body as claimed in claim 1, wherein the fastening layer is configured in a self-adhesive form that includes an adhesive.

14. The holding body as claimed in claim 1, wherein the fastening layer is configured as a substantially planar surface on which the flexible grinding device is configured to be fastened.

15. A holding body for a flexible grinding device comprising:

a fastening layer having a fastening surface and a holding surface located opposite from the fastening surface, the fastening surface having a fastening member configured to fasten the flexible grinding device; and a supporting body having a supporting surface connected to the holding surface of the fastening layer so as to support the fastening layer, wherein the fastening layer is formed from an air- and dust-permeable material and is configured to enable substantially uniform axial suction removal of air and grinding dust through substantially the entire fastening surface and substantially the entire fastening layer, wherein the supporting body is air- and dust-permeable and is configured to enable suction removal of air and grinding dust through the supporting body, and wherein the supporting surface is connected to the holding surface in an unreleasable manner.

16. The holding body as claimed in claim 1, wherein the fastening layer and the supporting body are configured to enable substantially uniform axial suction removal of air and dust through substantially the entire fastening surface and through the fastening layer and the supporting body.

17. The holding body as claimed in claim 10, wherein the fastening layer and the supporting body are configured to enable substantially uniform axial suction removal of air and dust through substantially the entire fastening surface and through the fastening layer and the supporting body.

18. The holding body as claimed in claim 15, wherein the fastening member includes at least one of loops and hooks protruding from the fastening surface.

19. The holding body as claimed in claim 15, wherein the supporting body includes an open-cell foam material, a knitted spacer fabric, or a honeycomb structure.

* * * * *